US008646943B2

(12) United States Patent
Wan et al.

(10) Patent No.: US 8,646,943 B2
(45) Date of Patent: Feb. 11, 2014

(54) TOWER-SHAPED LED MODULE

(75) Inventors: Yehua Wan, Zhejiang (CN); Fang Chen, Zhejiang (CN); Jinqiang Gu, Zhejiang (CN)

(73) Assignee: Zhejiang Shenghui Lighting Co., Ltd., Jiaxing, Zhejiang Province (CN)

( * ) Notice: Subject to any disclaimer, the term of this patent is extended or adjusted under 35 U.S.C. 154(b) by 283 days.

(21) Appl. No.: 13/143,929

(22) PCT Filed: Sep. 10, 2010

(86) PCT No.: PCT/CN2010/076795

§ 371 (c)(1),
(2), (4) Date: Jul. 9, 2011

(87) PCT Pub. No.: WO2011/156994

PCT Pub. Date: Dec. 22, 2011

(65) Prior Publication Data

US 2012/0243244 A1 Sep. 27, 2012

(30) Foreign Application Priority Data

Jun. 13, 2010 (CN) ..... 2010 2 0227831 U

(51) Int. Cl.
*F21V 21/00* (2006.01)

(52) U.S. Cl.
USPC ..... 362/249.02; 362/249.11; 362/800

(58) Field of Classification Search
USPC ..... 362/249.02, 249.11, 800, 409, 249, 362/432, 249.14
See application file for complete search history.

(56) References Cited

U.S. PATENT DOCUMENTS

| | | | | |
|---|---|---|---|---|
| 6,992,333 | B2 * | 1/2006 | Nagai et al. | 257/88 |
| 7,914,178 | B2 * | 3/2011 | Xiang et al. | 362/294 |
| D643,135 | S * | 8/2011 | Wan et al. | D26/2 |
| 8,282,240 | B2 * | 10/2012 | Xiao et al. | 362/249.02 |
| 2006/0193130 | A1 * | 8/2006 | Ishibashi | 362/227 |
| 2009/0103308 | A1 * | 4/2009 | Xu et al. | 362/294 |
| 2009/0116233 | A1 * | 5/2009 | Zheng et al. | 362/234 |
| 2009/0213602 | A1 * | 8/2009 | Gallegos | 362/488 |
| 2010/0053963 | A1 * | 3/2010 | Yang et al. | 362/249.02 |
| 2010/0207502 | A1 * | 8/2010 | Cao et al. | 313/46 |

FOREIGN PATENT DOCUMENTS

| | | | |
|---|---|---|---|
| JP | 3151747 U | * | 7/2009 |
| WO | PCT/CN2010/076795 | | 3/2011 |

* cited by examiner

*Primary Examiner* — Jong-Suk (James) Lee
*Assistant Examiner* — Leah S Macchiarolo
(74) *Attorney, Agent, or Firm* — Global IP Services; Tianhua Gu

(57) ABSTRACT

The present invention discloses a tower-shaped LED module that comprises a base, at least three LED panels mounted on the base and a bracket used to support the LED panels, wherein the LED panels are fixed on the bracket to form a pyramid. The present invention solves the traditional problem of the LED panels not secured firmly or shifting around easily. To fix the LED panels on the designed bracket, first slide each LED panel upward into sliding slots. Then insert each electrode pin of the LED panels into a corresponding pin hole in the base. Next put a screw though the base and fasten it to a supporting rod. At last solder the electrode pins of the LED panels to a printed circuit board on the bottom surface of the base. The whole assembly process is very simple and the assembled LED panels have good stability.

8 Claims, 3 Drawing Sheets

TOWER-SHAPED LED MODULE

CROSS REFERENCE TO RELATED PATENT APPLICATION

The present application is the US national stage of PCT/CN2010/076795 filed on Sep. 10, 2010, which claims the priority of the Chinese patent application No. 201020227831.X filed on Jun. 13, 2010, which application is incorporated herein by reference.

FIELD OF THE INVENTION

The present invention relates to a LED module, particularly to a tower-shaped LED module.

BACKGROUND OF THE INVENTION

LED lamps have the characteristics of low energy consumption, high illuminating efficiency, long service life and high use reliability. It has drawn more and more attention and has been gradually applied in the lighting industry. A LED module is usually constructed by disposing a plurality of LEDs on a flat panel. Thus the illumination angle of such a LED panel is generally between 100 degrees and 130 degrees because LED emission tends to be directional. As a result, illumination blind areas are formed around LED lamps, especially under the lamp cover. This greatly compromises the decorative effect of LED lamps when they are used as decoration.

An improved structure is to put a plurality of LED panels (LED emitting-surfaces) together to form a pyramid. Thus the illumination angle is increased and the illumination area is extended. However each LED panel is glued to a side of a pre-built pyramid. As a result, the LED panels may fall off when the glue is damaged by wasted heat. Last but not least, it is not easy to precisely position the LED panels on the pyramid when glue is applied, which may compromise the appearance of the LED lamps.

SUMMARY OF THE INVENTION

In order to solve the above technical problems, the present invention provides a tower-shaped LED module which will be easy to assemble, and on which LED panels will be secured firmly and not be displaced.

A technical solution of the present invention is as follows:

A tower-shaped LED module comprises a base, at least three LED panels mounted on the base and a bracket used to support the LED panels, wherein the LED panels are fixed on the bracket to form a pyramid.

As a preferred embodiment, the bracket comprises a supporting rod. A plurality of supporting panels are disposed evenly and radially outward along a side wall of the supporting rod. Each area between two adjacent supporting panels may accommodate a LED panel. A cover member is placed on top of the supporting rod. A plurality of edges of the cover member are extended downward respectively with a side panel along a side of the supporting panel. Both left and right edges of the side panel are beyond the width of the side of the supporting panel. Both left and right edges of the side panel are bent inward to form open hems for covering edges of the LED panel, thereby allowing both left and right edges of the LED panel to be slid into sliding slots formed between the open hems and the side panel. Once a LED panel is fixed, only the emitting-surface is exposed. Both left and right edges of the LED panel are covered by the hems, which makes the LED panel not slip off the bracket. Both left and right edges of the LED panel are also supported by the side panel, which makes it not shift around or loosen over time. Compare to the structure described in the background art, the mechanical strength of the present structure is increased and the LED panel is secured more firmly.

As a preferred embodiment, a threaded hole is provided at the bottom of the supporting rod. Correspondingly, a through hole is provided in the center of the base. And a screw is screwed into the threaded hole passing the through hole. Thus the bracket and the base are connected by a screw, which enables easy disassembly and secure fastening.

In order to achieve better positioning and to prevent the bracket from rotating, as a preferred embodiment, a foot member is disposed at the bottom of each side panel. Correspondingly, a plurality of notches for accommodating the foot members respectively are provided around a rim of the base. And each foot member is inserted into one of the notches.

As a preferred embodiment, within each area between two adjacent supporting panels, a head member s placed between two top parts of the open hems. And a top part of the head member joins the cover member. Thus the head member covers a top part of the LED panel, which not only secures the top part of the LED panel, but also improves overall appearance.

As a preferred embodiment, a printed circuit board is placed on a bottom surface of the base. Two electrode pins are disposed on each LED panel. Correspondingly, pin holes are provided in the base. And each electrode pin is soldered to the printed circuit board through one of the pin holes. As a result, the printed circuit board is hidden below the base, which improves overall appearance.

As a preferred embodiment, a plurality of LED chips are soldered on each LED panel. The power of the LED chips is usually less than 5 W. Thus wasted heat is released easily and illumination will not be affected.

As a preferred embodiment, three LED panels are mounted on the base and the LED panels are fixed on the bracket to form a triangular pyramid. This present triangular pyramid structure is simpler and more reasonable than that described in the background art.

The advantages offered by the above technical solution are as follows:

The present invention solves the traditional problem of the LED panels not secured firmly as well as shifting around easily. To fix the LED panels on the designed bracket, first slide each LED panel upward into the sliding slots. Then insert each electrode pin of the LED panels into the corresponding pin hole in the base. Next put the screw though the base and fasten it to the supporting rod. At last solder the electrode pins of the LED panels to the printed circuit board on the bottom surface of the base. The whole assembly process is very simple. The assembled LED panels have good stability and will not shift around or fall off.

DETAILED DESCRIPTION OF THE INVENTION

Figure 1:
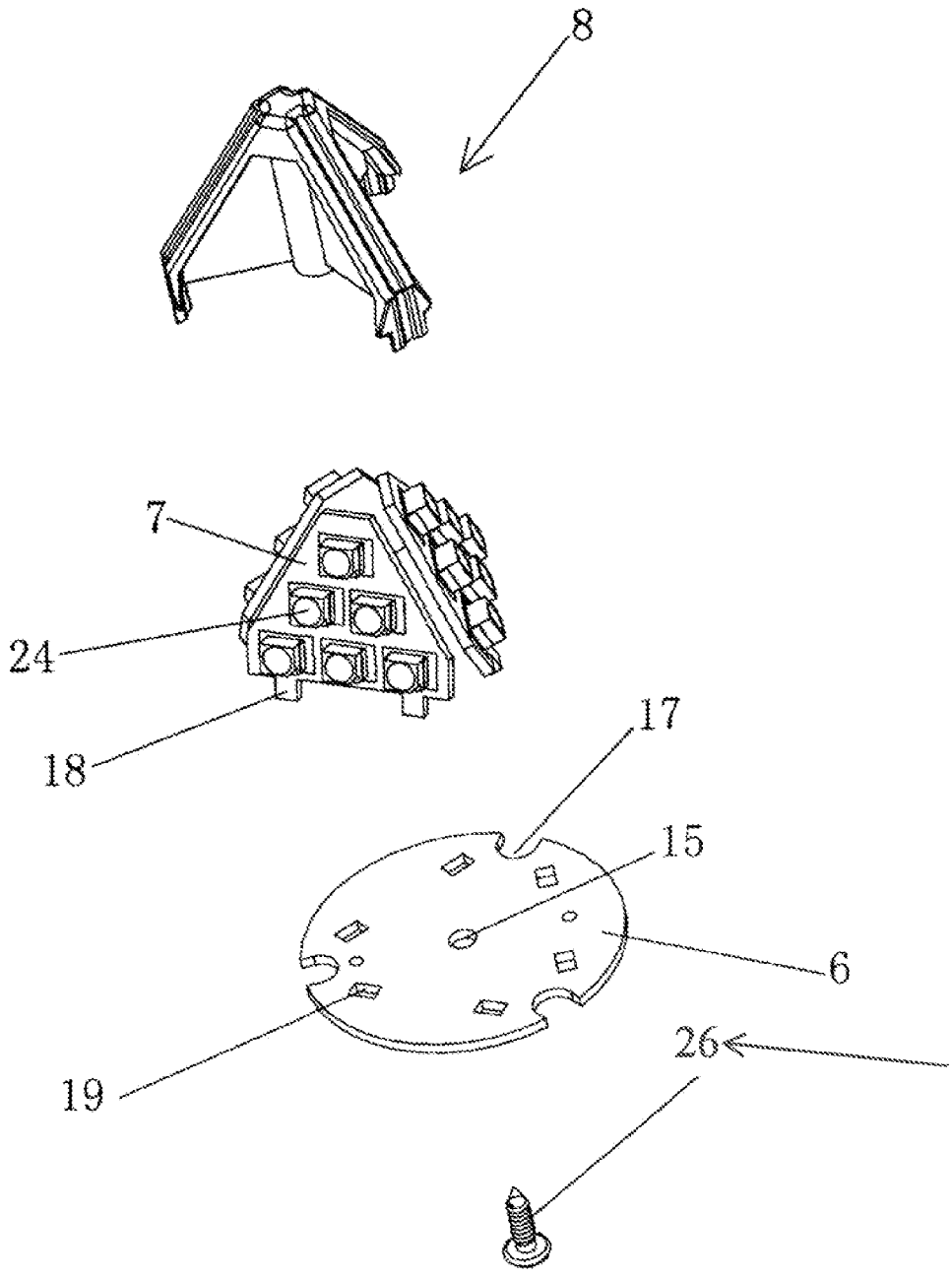
FIG. 1 is an exploded view of the present invention.

A detailed description of the present invention is as follows:

A tower-shaped LED module, as shown in FIG. 1, comprises a base 6, three LED panels 7 mounted on the base 6 and a bracket 8 used to support the LED panels 7, wherein the shape of the LED panels 7 is triangle-like and the LED panels 7 are fixed on the bracket 8 to form a triangular pyramid.

Each LED panel 7 has a plurality of LED chips 24 soldered on it.

Figure 2:
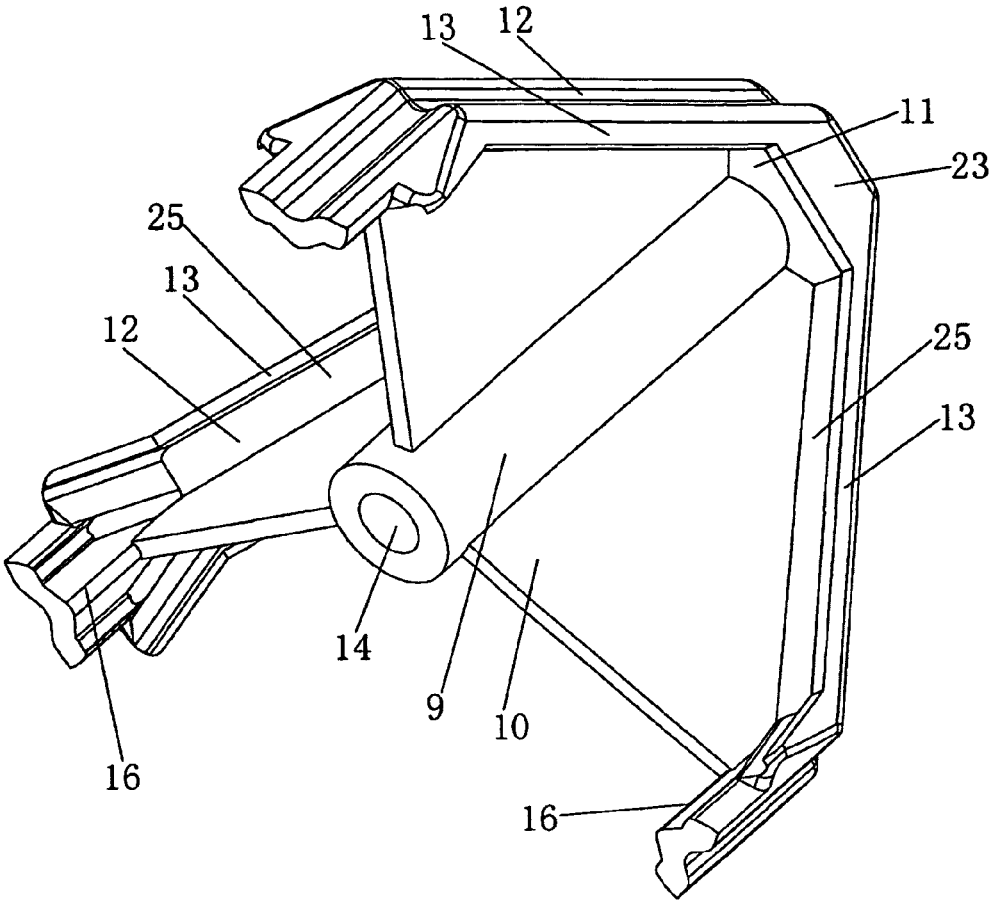
FIG. 2 is an auxiliary view of a bracket embodying the invention.
Figure 3:
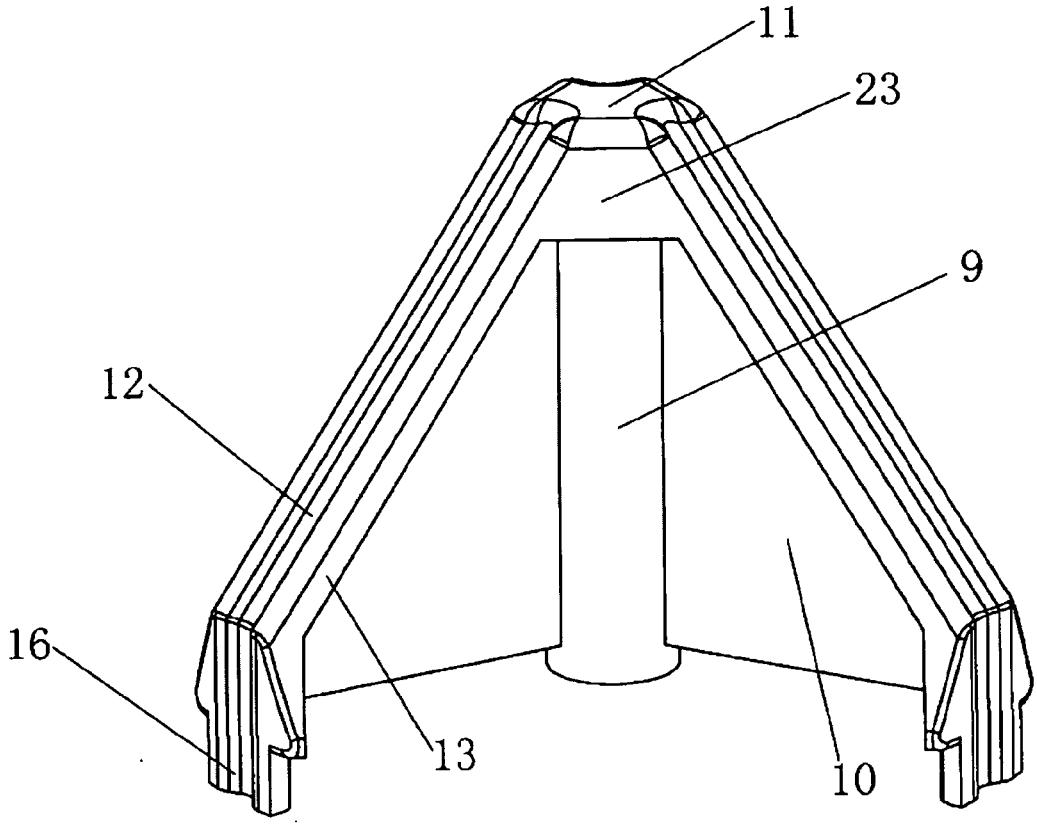
FIG. 3 is an elevation view of the bracket.

As shown in FIGS. 2 and 3, the bracket 8 comprises a supporting rod 9. The shape of the supporting rod 9 is cylinder-like. Three supporting panels 10 are disposed evenly and radially outward along a side wall of the supporting rod 9. Each area between two adjacent supporting panels 10 may accommodate a LED panel. A cover member 11 is placed on top of the supporting rod 9. Three edges of the cover member 11 are extended downward respectively with a side panel 12 along a side of the supporting panel 10. Both left and right edges of the side panel 12 are beyond the width of the side of the supporting panel 10; the shape of the side panel 12 is the same as that of a side of the LED panel; both left and right edges of the side panel 12 are bent inward; and thereby forming open hems 13 for covering edges of the LED panel. Both left and right edges of the LED panel 7 are slid into sliding slots formed between the open hems 13 and the side panel 12; the LED chips 24 on the LED panel 7 are all exposed outside; and therefore the LED lights are secured firmly and illumination is not affected. A foot member 16 is disposed at the bottom of each side panel 12. Three notches 17 for accommodating the three foot members 16 respectively are provided around a rim of the base 6, thereby allowing each foot member 16 to be inserted into one of the notches 17. Within each area between two adjacent supporting panels, a head member 23 is placed between two top parts of the open hems 13, and a top part of the head member 23 joins the cover member 11.

As shown in FIG. 2, a threaded hole 14 is provided at the bottom of the supporting rod 9; as shown in FIG. 1, a through hole 15 is provided in the center of the base 6 correspondingly; thereby allowing a screw 26 to be screwed into the threaded hole 14 passing the through hole 15.

As shown in FIG. 1, a printed circuit board (not shown in the Figure) is placed on a bottom surface of the base 6. Two electrode pins 18 are disposed on each LED panel 7. Correspondingly, pin holes 19 are provided in the base 6. Thus each electrode pin 18 can be soldered to the printed circuit board through one of the pin holes 19.

What is claimed is:

1. A tower-shaped LED module, comprising a base (6), at least three LED panels (7) mounted on the base (6) and a bracket (8) used to support the LED panels (7), wherein the LED panels (7) are fixed on the bracket (8) to form a pyramid; the bracket (8) comprises a supporting rod (9); a plurality of supporting panels (10) are disposed evenly and radially outward along a side wall of the supporting rod (9); each area between two adjacent supporting panels (10) accommodates a LED panel; a cover member (11) is placed on top of the supporting rod (9); a plurality of edges of the cover member (11) are extended downward respectively with a side panel (12) along a side of the supporting panel (10); both left and right edges of the side panel (12) are beyond the width of the side of the supporting panel (10); both left and right edges of the side panel (12) are bent inward to form open hems (13) for covering edges of the LED panel; and both left and right edges of the LED panel (7) are slid into sliding slots formed between the open hems (13) and the side panel (12).

2. The tower-shaped LED module according to claim 1, wherein a threaded hole (14) is provided at the bottom of the supporting rod (9); a through hole (15) is provided in the center of the base (6) correspondingly; and a screw (26) is screwed into the threaded hole (14) passing the through hole (15).

3. The tower-shaped LED module according to claim 2, wherein a foot member (16) is disposed at the bottom of each side panel (12); a plurality of notches (17) for accommodating the foot members (16) respectively are provided around a rim of the base (6); and each foot member (16) is inserted into one of the notches (17).

4. The tower-shaped LED module according to claim 1, wherein a foot member (16) is disposed at the bottom of each side panel (12); a plurality of notches (17) for accommodating the foot members (16) respectively are provided around a rim of the base (6); and each foot member (16) is inserted into one of the notches (17).

5. The tower-shaped LED module according to claim 1, wherein within each area between two adjacent supporting panels, a head member (23) is placed between two top parts of the open hems (13); and a top part of the head member (23) joins the cover member (11).

6. The tower-shaped LED module according to claim 1, wherein a printed circuit board is placed on a bottom surface of the base (6); two electrode pins (18) are disposed on each LED panel (7); pin holes (19) are provided in the base (6) correspondingly; and each electrode pin (18) is soldered to the printed circuit board through one of the pin holes (19).

7. The tower-shaped LED module according to claim 1, wherein a plurality of LED chips (24) are soldered on each LED panel (7).

8. The tower-shaped LED module according to claim 1, wherein three LED panels (7) are mounted on the base (6) and the LED panels (7) are fixed on the bracket (8) to form a triangular pyramid.

* * * * *